US007269945B2

(12) United States Patent
Bae

(10) Patent No.: US 7,269,945 B2
(45) Date of Patent: Sep. 18, 2007

(54) METHOD FOR COMPENSATING FLOW RATE AT NEUTRAL POSITION OF OPERATION LEVER OF CONSTRUCTION EQUIPMENT

(75) Inventor: Sang Ki Bae, Changwon (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 554 days.

(21) Appl. No.: 10/937,474

(22) Filed: Sep. 9, 2004

(65) Prior Publication Data

US 2005/0226732 A1 Oct. 13, 2005

(30) Foreign Application Priority Data

Apr. 8, 2004 (KR) ..... 10-2004-0024047

(51) Int. Cl.
*F15B 21/08* (2006.01)
*F15B 11/16* (2006.01)
*E02F 9/22* (2006.01)

(52) U.S. Cl. ..... 60/431; 60/445; 60/449

(58) Field of Classification Search ..... 60/431, 60/433, 445, 449
See application file for complete search history.

(56) References Cited

U.S. PATENT DOCUMENTS 5,447,027 A 9/1995 Ishikawa et al.
5,974,796 A * 11/1999 Ishikawa et al. ..... 60/445
6,020,651 A * 2/2000 Nakamura et al. ..... 290/40 R
6,173,572 B1 1/2001 Cobo et al.
6,305,162 B1 * 10/2001 Cobo et al. ..... 60/431
7,007,466 B2 * 3/2006 Price ..... 60/431

FOREIGN PATENT DOCUMENTS

EP 0 848 113 6/1998
EP 0 884 422 12/1998

* cited by examiner

*Primary Examiner*—Thomas E. Lazo
(74) *Attorney, Agent, or Firm*—Ladas and Parry LLP

(57) ABSTRACT

A method for compensating a flow rate at a neutral position of an operation lever of construction equipment is adapted so that when RPM of an engine becomes different, an actuator can be identically driven according to an operating amount of the operation lever. The method comprises the steps of: setting a first flow rate related to the operation lever and a second flow rate related to the engine; evaluating whether the operation lever is at the neutral position, and controlling the hydraulic pump to discharge a minimum flow rate; when the operation lever is not at the neutral position and when the second flow rate for compensating the engine rpm is more than the first flow rate for the operation lever, controlling the hydraulic pump to discharge the second flow rate for compensating the engine rpm; and when the operation lever is not located at the neutral position and when the first flow rate for the operation lever is more than the second flow rate for compensating the engine rpm, controlling the hydraulic pump to discharge the flow rate corresponding to the operating amount of the operation lever.

4 Claims, 5 Drawing Sheets

METHOD FOR COMPENSATING FLOW RATE AT NEUTRAL POSITION OF OPERATION LEVER OF CONSTRUCTION EQUIPMENT

BACKGROUND OF THE INVENTION

1. Field of the Invention

The present invention relates to a method for compensating a flow rate at a neutral position of an operation lever of construction equipment, capable of optimally controlling a displacement of a hydraulic pump according to an operating amount of the operation lever when the construction equipment such as an excavator is controlled on operation thereof using the operation lever.

More specifically, the present invention is directed to a method for compensating a flow rate at a neutral position of an operation lever of construction equipment, capable of enhancing the manipulation ability by enabling an actuator to be equally driven according to an operating amount of the operation lever even when an RPM (revolutions per minute) of an engine becomes different and of reducing consumption of fuel by minimizing a displacement of a hydraulic pump when the operation lever is located at the neutral position.

2. Description of the Related Art

In general, an electrical operation lever used for construction equipment outputs a signal proportional to its operating amount by manipulation of an operator (exemplary output types of the signal may include analogue voltage, PWM (pulse width modulation), and communication signals, etc.).

In accordance with the signal inputted from the operation lever, controller outputs a controlling signal proportional to operating amounts of the operation lever and pedal to an electrical proportional valve, so that working units such as a boom, an arm, and a bucket are driven to readily perform necessary working such as excavating, loading and lifting.

In a hydraulic circuit using a plurality of hydraulic pumps, a displacement is controlled by a discharged pressure of its opposite hydraulic pump in order to efficiently use the construction equipment.

In other words, when a small load is generated from the opposite hydraulic pump, a flow rate is controlled to be much discharged, and thereby efficiency is enhanced, and simultaneously the displacement of the hydraulic pump is controlled according to a difference between a preset RPM of the engine and its current RPM, and thereby motive power of the engine is used to the maximum level.

Further, when an excessive load is generated from the working unit or the like, the discharged flow rate of the hydraulic pump is reduced, and thereby efficiency of the construction equipment is enhanced.

When the operation lever is operated, a signal from the operation lever is detected to control the discharged flow rate of the hydraulic pump, and then the displacement of the hydraulic pump is controlled according to the detected signal. Further, the discharged pressure of the hydraulic pump is detected in order to constantly maintain used motive power of the hydraulic pump, and then the displacement is controlled according to the detected pressure.

However, in order to optimally control the displacement of the hydraulic pump, various pilot signals are detected. As the displacement is controlled by the detected signals, the working units such as the boom are independently controlled. For this reason, the operator has a great difficulty in controlling the hydraulic pump in the optimal state in the working site.

SUMMARY OF THE INVENTION

Therefore, an objective of the present invention is to provide a method for compensating a flow rate at a neutral position of an operation lever of construction equipment, capable of enhancing manipulation ability by previously setting a discharged flow rate of an hydraulic pump according to a working mode and by enabling an actuator to be equally driven according to an operating amount of the operation lever even when an RPM (revolutions per minute) of an engine becomes different.

Another objective of the present invention is to provide a method for compensating a flow rate at a neutral position of an operation lever of construction equipment, capable of reducing consumption of fuel by minimizing a discharged flow rate of a hydraulic pump when the operation lever is located at the neutral position.

In order to accomplish these objectives, according to one aspect of the present invention, there is provided a method for compensating a flow rate at a neutral position of an operation lever of construction equipment, in which the construction equipment has a hydraulic pump connected to an engine, an actuator connected to the hydraulic pump and driving a working unit, a control valve installed on a fluid channel between the hydraulic pump and the actuator, the operation lever manipulated by an operator and generating an operating signal for driving the working unit, means for detecting an operating amount of the operation lever, means for detecting RPM (revolutions per minute) of the engine, a controller controlling the control valve in response to the operating signal depending on the operating amount of the operation lever and the detecting signal depending on the RPM of the engine, the method comprising the steps of: setting a first flow rate required according to the operating amount of the operation lever and a second flow rate required according to the RPM of the engine; evaluating whether the flow rate belongs to a section to be compensated at the neutral position based on a difference between the first flow rate for the operation lever and the second flow rate for compensating the engine rpm; controlling the hydraulic pump to discharge the second flow rate for compensating the engine rpm when the second flow rate for compensating the engine rpm is more than the first flow rate for the operation lever; and controlling the hydraulic pump to discharge the flow rate corresponding to the operating amount of the operation lever when the first flow rate for the operation lever is more than the second flow rate for compensating the engine rpm.

According to another aspect of the present invention, there is provided a method for compensating a flow rate at a neutral position of an operation lever of construction equipment, in which the construction equipment has a hydraulic pump connected to an engine, an actuator connected to the hydraulic pump and driving a working unit, a control valve installed on a fluid channel between the hydraulic pump and the actuator, the operation lever manipulated by an operator and generating an operating signal for driving the working unit, means for detecting an operating amount of the operation lever, means for detecting RPM (revolutions per minute) of the engine, a controller controlling the control valve in response to the operating signal depending on the operating amount of the operation lever and the detecting signal depending on the RPM of the engine, the method comprising the steps of: setting a first flow rate required according to the operating amount of the operation lever and a second flow rate required according to the RPM of the engine; evaluating whether the operation lever is located at the neutral position by the operating signal, and when the operation lever is located at the neutral position, controlling a displacement of the hydraulic pump to discharge a minimum flow rate from the hydraulic pump; when the operation lever is not located at the neutral position and when the second flow rate for compensating the engine rpm is more than the first flow rate for the operation lever, controlling the hydraulic pump to discharge the second flow rate for compensating the engine rpm; and when the operation lever is not located at the neutral position and when the first flow rate for the operation lever is more than the second flow rate for compensating the engine rpm, controlling the hydraulic pump to discharge the flow rate corresponding to the operating amount of the operation lever.

Here, the operation lever may make use of any one of an electrical operation lever and a hydraulic operation lever.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE INVENTION

The present invention will now be described more fully hereinafter with reference to the accompanying drawings, which should be construed as intended for such a detailed description that those skilled in the art can easily carry out the invention, but not for limitation to technical spirit and scope of the invention due to the detailed description.

Figure 3:
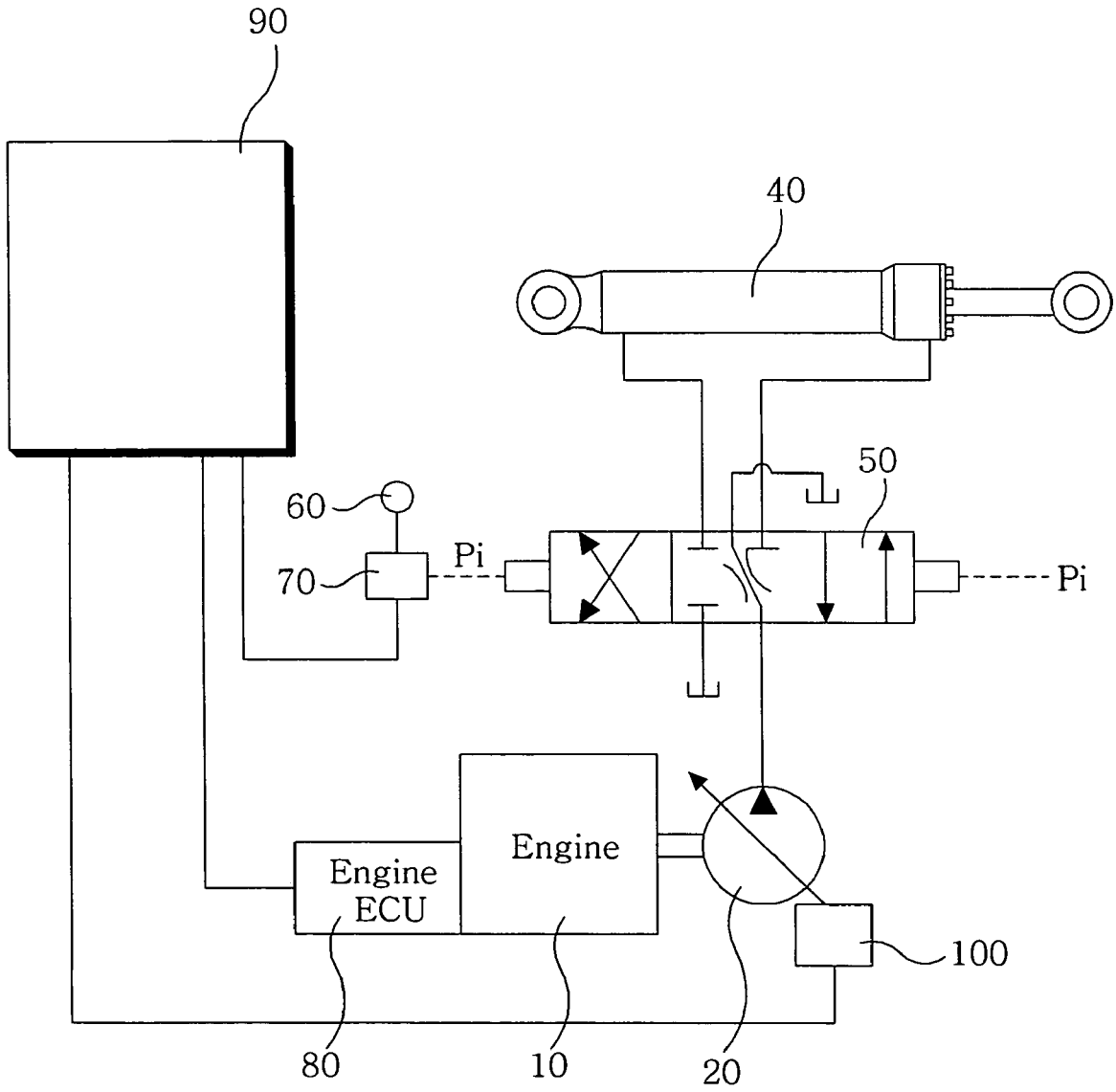
FIG. 3 is a schematic hydraulic circuit diagram used in a method for compensating a flow rate at a neutral position of an operation lever of construction equipment in accordance with one embodiment of the present invention.

As shown in FIG. 3, this invention is applied to any construction equipment which comprises an engine 10, a hydraulic pump 20 connected to the engine 10, an actuator 40 connected to the hydraulic pump 20 and driving a working unit such as a boom, a control valve 50 installed on a fluid channel between the hydraulic pump 20 and the actuator 40, an operation lever 60 manipulated by an operator and generating an operating signal for driving the working unit, operating amount detecting means 70 for detecting an operating amount of the operation lever, RPM (revolutions per minute) detecting means 80 for detecting an RPM of the engine 10, a controller 90 controlling the control valve 50 in response to the operating signal depending on the operating amount of the operation lever 60 and the detecting signal depending on the RPM of the engine, and an regulator 100 controlling a displacement of the hydraulic pump 20, all of which are used in the technical field of the invention. Hence, detailed description thereof will be omitted.

Hereinafter, a detailed description will be made regarding a method for compensating a flow rate when an operation lever of construction equipment is placed at a neutral position in accordance with one embodiment of the present invention, particularly, regarding application thereof, with reference to the accompanying drawings.

Figure 1:
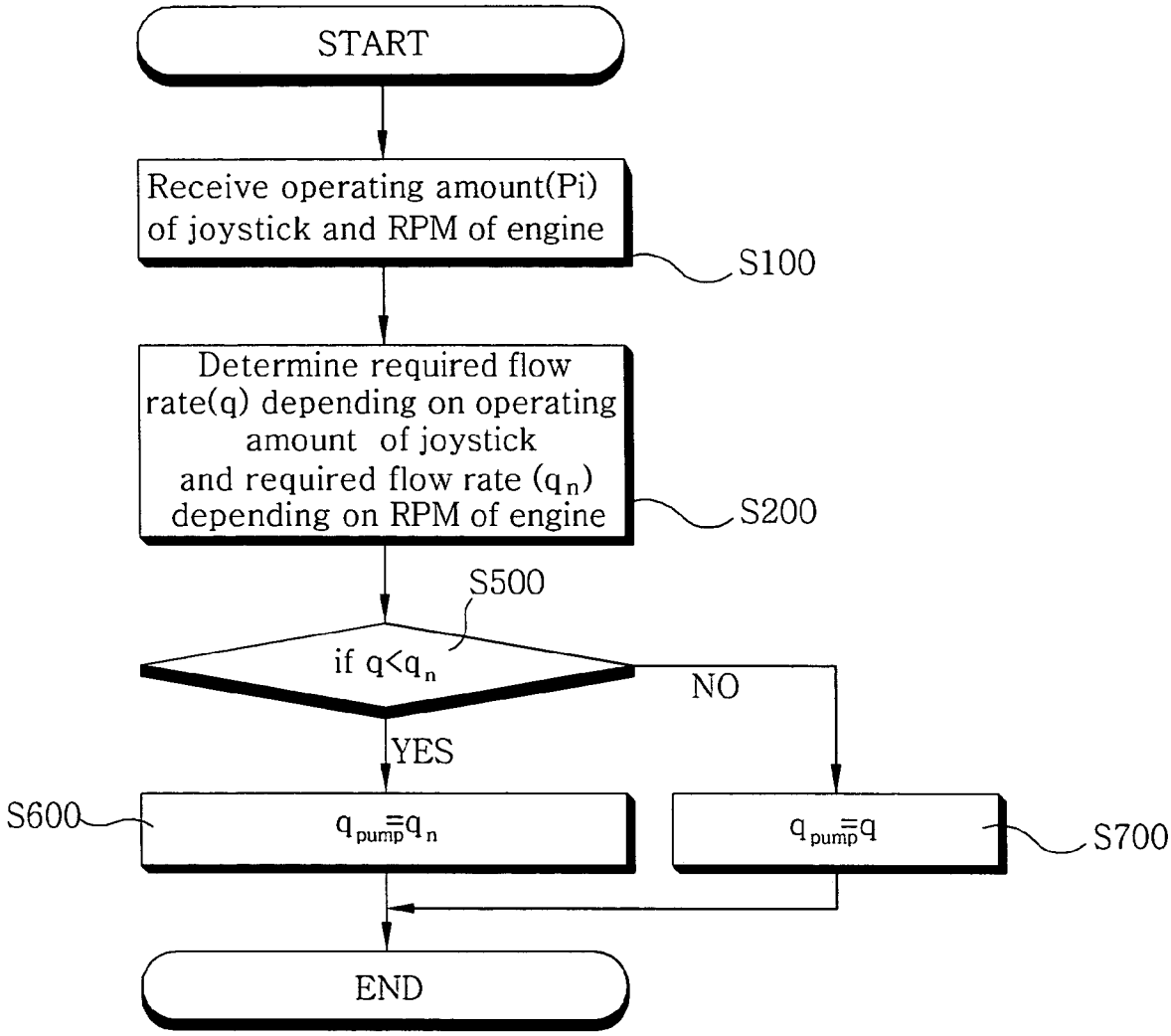
FIG. 1 is a flow chart illustrating a method for compensating a flow rate at a neutral position of an operation lever of construction equipment in accordance with one embodiment of the present invention.
Figure 2:
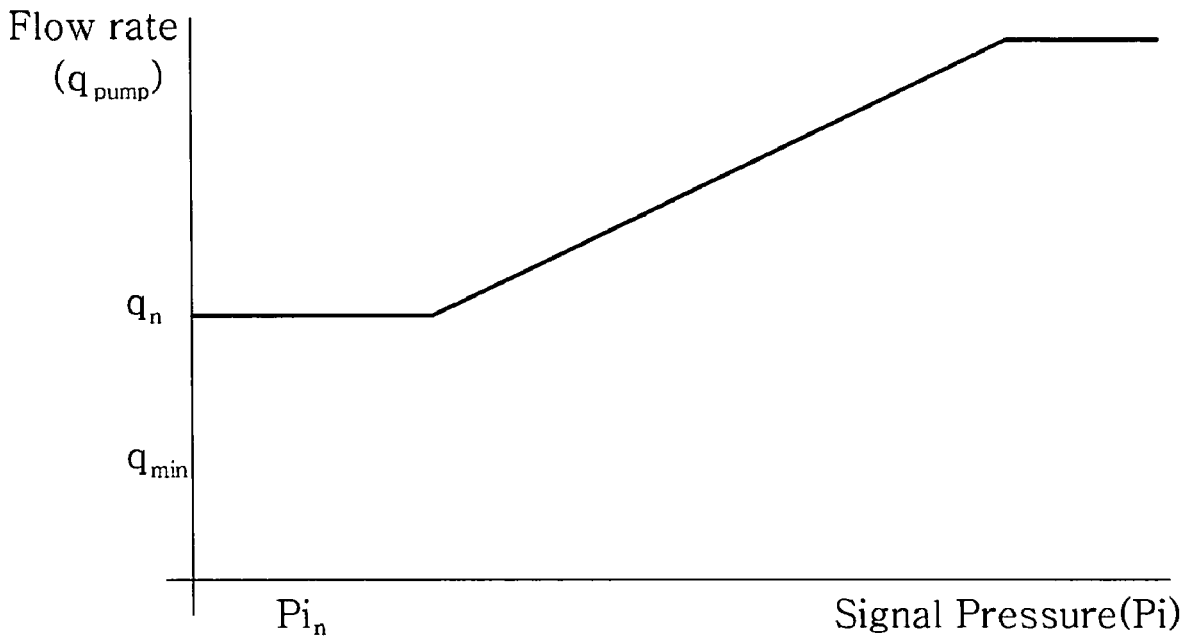
FIG. 2 is a graph illustrating a characteristic of a discharged flow rate against an operating amount of an operation lever in accordance with one embodiment of the present invention.

As shown in FIGS. 1 to 3, an operating signal Pi and a detecting signal are inputted into the controller 90, wherein the operating signal Pi depends on the operating amount of the operation lever 60 which is detected by the operating amount detecting means 70, and the detecting signal depends on the RPM of the engine which is detected by the RPM detecting means 80 (S100).

At the controller 90, a required flow rate q depending on the operating amount of the operation lever 60 and a required flow rate $q_n$ depending on the RPM of the engine are previously determined (S200).

On the basis of a difference between the required flow rate q depending on the operating amount of the operation lever and the required flow rate $q_n$ depending on the RPM of the engine, it is evaluated whether the flow rate belongs to a section to be compensated at the neutral position or not (S500).

When it is evaluated in step S500 that the flow rate belongs to the section to be compensated at the neutral position (i.e. when $q<q_n$), a controlling signal inputted from the controller 90 controls the hydraulic pump 20 to discharge the required flow rate $q_n$ for compensating the RPM of the engine (S600).

When it is evaluated in step S500 that the required flow rate q for the operation lever is more than the required flow rate $q_n$ for compensating the engine rpm, the hydraulic pump is controlled such that the flow rate corresponding to the operating amount of the operation lever 60 is discharged (S700).

A detailed description will be made regarding a method for compensating a flow rate when an operation lever of construction equipment is placed at a neutral position in accordance with another embodiment of the present invention, particularly, regarding application thereof, with reference to FIGS. 4 and 5.

Figure 4:
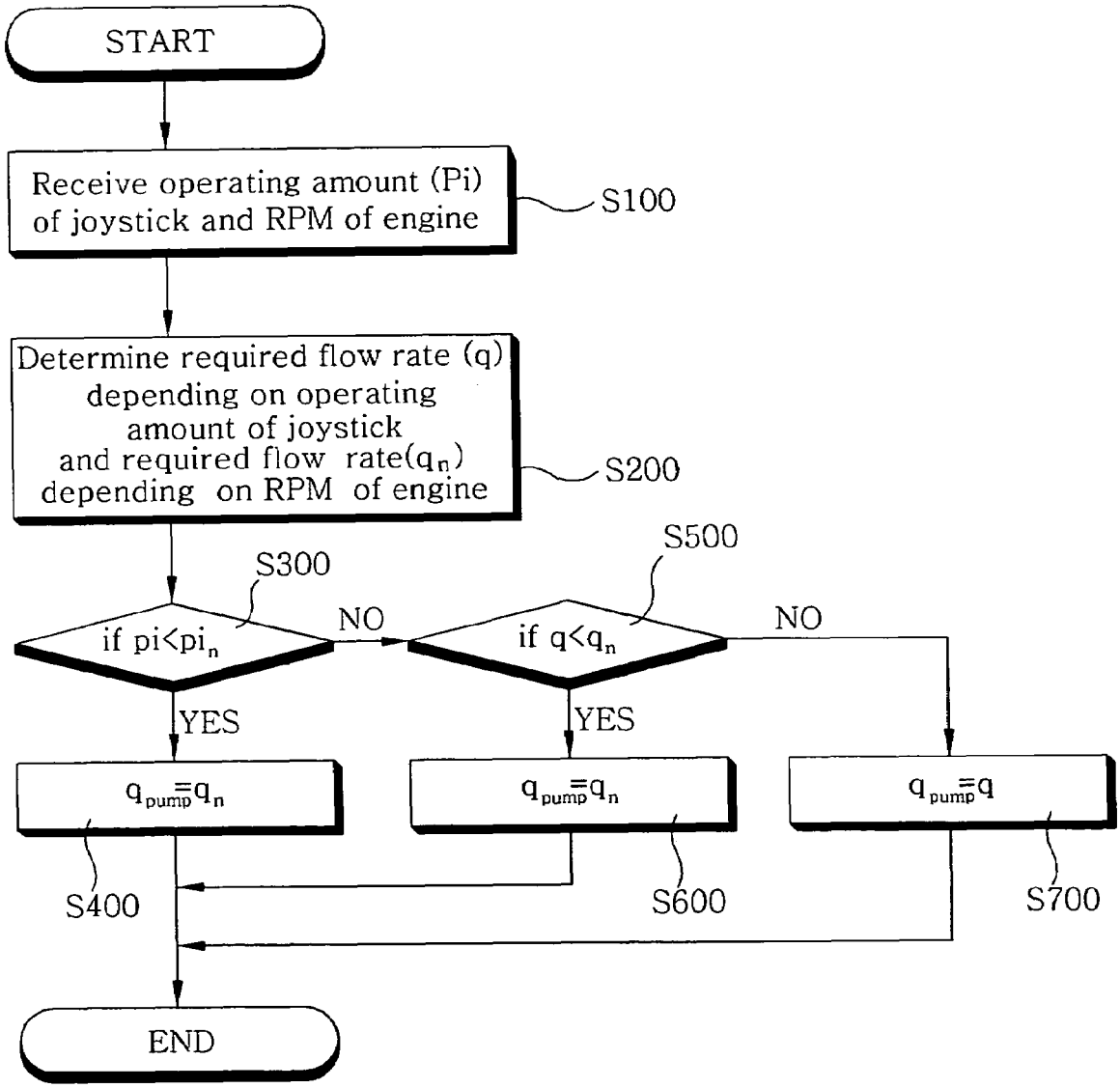
FIG. 4 is a flow chart illustrating a method for compensating a flow rate at a neutral position of an operation lever of construction equipment in accordance with another embodiment of the present invention.
Figure 5:
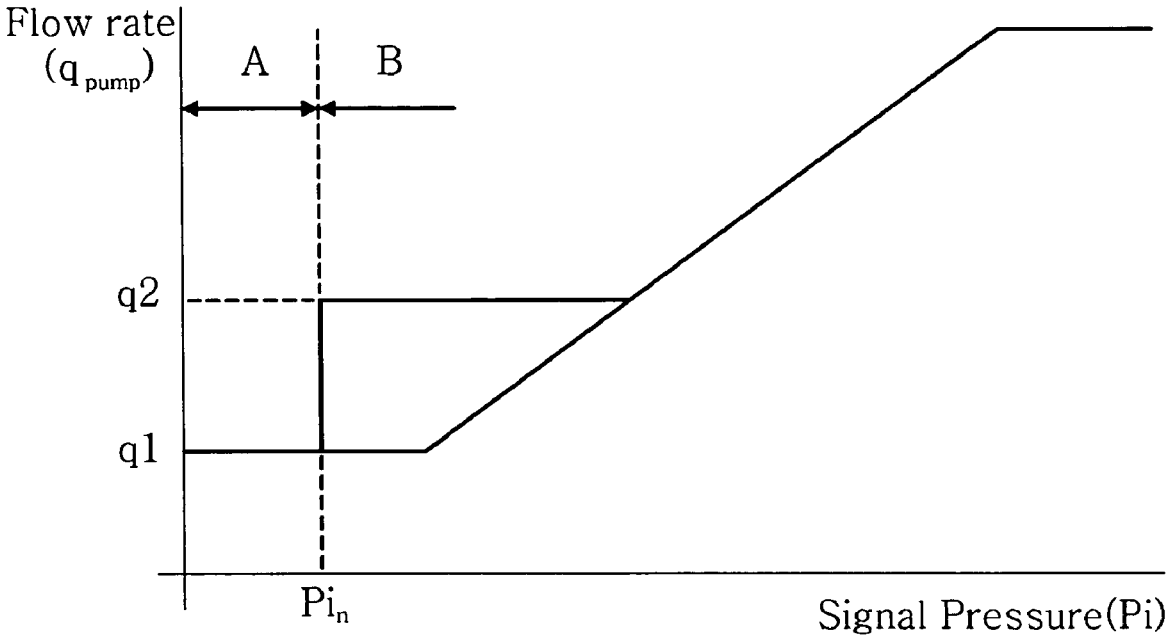
FIG. 5 is a graph illustrating a characteristic of a discharged flow rate against an operating amount of an operation lever in accordance with another embodiment of the present invention.

As shown in FIGS. 4 and 5, the operating signal Pi and the detecting signal are inputted into the controller 90, wherein the operating signal Pi depends on the operating amount of the operation lever 60 which is detected by the operating amount detecting means 70, and the detecting signal depends on the RPM of the engine which is detected by the RPM detecting means 80 (S100).

At the controller 90, the required flow rate q depending on the operating amount of the operation lever and the required flow rate $q_n$ depending on the RPM of the engine are previously determined (S200).

Based on a value of the required flow rate q depending on the operating signal Pi and the operating amount of the operation lever 60, it is evaluated whether the operation lever 60 is located at the neutral position or not (S300).

When it is evaluated in step S300 that the operation lever 60 is located at the neutral position (i.e. when $Pi<Pi_n$ and indicated by "A" in FIG. 5), a controlling signal inputted from the controller 90 to the regulator 100 controls the displacement of the hydraulic pump 20 to minimize the discharged flow rate of the hydraulic pump 20.

In step S300, if the operation lever 60 is not located at the neutral position, it is evaluated whether or not the flow rate belongs to a section to be compensated at the neutral position, on the basis of the difference between the required flow rate q depending on the operating amount of the operation lever and the required flow rate $q_n$ depending on the RPM of the engine (S500).

When it is evaluated in step S300 that the operation lever 60 is not located at the neutral position and that the flow rate belongs to a section to be compensated at the neutral position (i.e. when $q<q_n$ and indicated by "B" in FIG. 5), a controlling signal inputted from the controller 90 controls the hydraulic pump 20 to discharge the required flow rate $q_n$ for compensating the RPM of the engine (S600).

When it is evaluated in step S300 that the operation lever 60 is not located at the neutral position and that the required flow rate q for the operation lever is more than the required flow rate $q_n$ for the RPM of the engine (i.e. when $q>q_n$), the hydraulic pump is controlled such that the flow rate corresponding to the operating amount of the operation lever 60 is discharged (S700).

As shown in FIG. 3, the flow rate Q discharged from the hydraulic pump 20 refers to a product of the RPM of the engine 10 and the displacement of the hydraulic pump 20 as follows.

Q=RPM×q (where q is the displacement of the hydraulic pump 20)

The flow rate discharged from the hydraulic pump 20 is varied according to the RPM of the engine 10.

Since the RPM of the engine 10 is adjusted according to a working mode, the flow rate Q is varied due to a RPM difference of the engine caused by the working mode even when the displacement of the hydraulic pump 20 is equal. A spool of the control valve 50 driving the actuator (hydraulic cylinder) 40 has a different position according to the working mode under the condition that a load pressure is equal Thereby, the signal pressure Pi switching the spool of the control valve 50 is varied according to the working mode, and thus manipulation capability is deteriorated.

However, when the method for compensating the flow rate is applied, reduction of the flow rate caused by decrease of the RPM of the engine is compensated by increase of q. Thus, there is no difference in the operating amount driving the actuator according to the working mode under the condition that the load pressure is equal, so that it is possible to facilitate operation.

As shown in FIGS. 2 and 5, even when the signal pressure Pi applied to the control valve 50 is zero, consumption (motive) power of the hydraulic pump 20 is increased when the slant plate of the hydraulic pump 20 is controlled by the flow rate of q2, so that consumption of fuel is increased.

In consideration of this, as indicated by "A" in FIG. 5, when the operation lever 60 is located at the neutral position (i.e. when $Pi<Pi_n$), the displacement of the hydraulic pump 20 is controlled as small as possible so that the minimum flow rate is discharged from the hydraulic pump 20.

On the other hand, when $Pi>Pi_n$ as when the flow rate belongs to the section to be compensated at the neutral position (indicated by "B" in FIG. 5), the slant plate of the hydraulic pump 20 is controlled by the flow rate of q2, so that consumption of fuel can be minimized when the pilot signal pressure Pi applied to the control valve 50 is zero.

Therefore, when the operation lever 60 is located at the neutral position, the displacement of the hydraulic pump 20 is controlled as small as possible (here, the RPM of the engine is high). By contrast, when the flow rate belongs to the section to be compensated at the neutral position, the slant plate of the hydraulic pump 20 is increased (here, the RPM of the engine is low). Even if the RPM of the engine becomes different according to the working condition, when the operation lever is manipulated at the same operating amount, it can be seen that a driving amount of the actuator is identical.

As set forth above, the method for compensating the flow rate when the operation lever of construction equipment is placed at the neutral position in accordance with the present invention has advantages as follows.

The discharged flow rate of the hydraulic pump is previously set according to the working mode, and the actuator is identically driven according to the operating amount of the operation lever even when the RPM of the engine becomes different. Thereby, the manipulation capability can be improved.

Further, when the operation lever is located at the neutral position, the discharged flow rate of the hydraulic pump is minimized. Thereby, it is possible to reduce the consumption of fuel.

Although a preferred embodiment of the present invention has been described for illustrative purposes, it is apparent to those skilled in the art that various modifications, additions and substitutions are possible, without departing from the scope and spirit of the invention as disclosed in the accompanying claims.

What is claimed is:

1. A method for compensating a flow rate at a neutral position of an operation lever of construction equipment, in which the construction equipment has a hydraulic pump connected to an engine, an actuator connected to the hydraulic pump and driving a working unit, a control valve installed on a fluid channel between the hydraulic pump and the actuator, the operation lever manipulated by an operator and generating an operating signal for driving the working unit, means for detecting an operating amount of the operation lever, means for detecting RPM (revolutions per minute) of the engine, a controller controlling the control valve in response to the operating signal depending on the operating amount of the operation lever and the detecting signal depending on the RPM of the engine, the method comprising the steps of:

setting a first flow rate required according to the operating amount of the operation lever and a second flow rate required according to the RPM of the engine;

evaluating whether the flow rate belongs to a section to be compensated at the neutral position based on a difference between the first flow rate for the operation lever and the second flow rate for compensating the engine rpm;

controlling the hydraulic pump to discharge the second flow rate for compensating the engine rpm when the second flow rate for compensating the engine rpm is more than the first flow rate for the operation lever; and controlling the hydraulic pump to discharge the flow rate corresponding to the operating amount of the operation lever when the first flow rate for the operation lever is more than the second flow rate for compensating the engine rpm.

2. A method for compensating a flow rate at a neutral position of an operation lever of construction equipment, in which the construction equipment has a hydraulic pump connected to an engine, an actuator connected to the hydraulic pump and driving a working unit, a control valve installed on a fluid channel between the hydraulic pump and the actuator, the operation lever manipulated by an operator and generating an operating signal for driving the working unit, means for detecting an operating amount of the operation lever, means for detecting RPM (revolutions per minute) of the engine, a controller controlling the control valve in response to the operating signal depending on the operating amount of the operation lever and the detecting signal depending on the RPM of the engine, the method comprising the steps of:

setting a first flow rate required according to the operating amount of the operation lever and a second flow rate required according to the RPM of the engine;

evaluating whether the operation lever is located at the neutral position by the operating signal, and when the operation lever is located at the neutral position, controlling a displacement of the hydraulic pump to discharge a minimum flow rate from the hydraulic pump;

when the operation lever is not located at the neutral position and when the second flow rate for compensating the engine rpm is more than the first flow rate for the operation lever, controlling the hydraulic pump to discharge the second flow rate for compensating the engine rpm; and when the operation lever is not located at the neutral position and when the first flow rate for the operation lever is more than the second flow rate for compensating the engine rpm, controlling the hydraulic pump to discharge the flow rate corresponding to the operating amount of the operation lever.

3. The method as set forth in claim 1, wherein the operation lever makes use of any one of an electrical operation lever and a hydraulic operation lever.

4. The method as set forth in claim 2, wherein the operation lever makes use of any one of an electrical operation lever and a hydraulic operation lever.

* * * * *